US011655598B2

(12) United States Patent
Wilhelmi et al.

(10) Patent No.: US 11,655,598 B2
(45) Date of Patent: May 23, 2023

(54) EARTH WORKING MACHINE HAVING A POSITIVE CONNECTION BETWEEN THE ROTATING WORKING ASSEMBLY AND ITS ROTARY BEARING

(71) Applicant: Wirtgen GmbH, Windhagen (DE)

(72) Inventors: Hardy Wilhelmi, Dattenberg (DE); Karsten Buhr, Willroth (DE); Andreas Salz, Neustadt (DE); Sascha Spöth, Heistenbach (DE)

(73) Assignee: Wirtgen GmbH

( * ) Notice: Subject to any disclaimer, the term of this patent is extended or adjusted under 35 U.S.C. 154(b) by 180 days.

(21) Appl. No.: 17/171,292

(22) Filed: Feb. 9, 2021

(65) Prior Publication Data

US 2021/0269994 A1 Sep. 2, 2021

(30) Foreign Application Priority Data

Feb. 28, 2020 (DE) ..... 10 2020 105 391.6

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127; F16D 7/042; F16D 7/044; F16D 7/046; F16D 41/22; F16D 43/26; F16H 1/003; F16H 35/06; F16H 35/10
USPC ..... 172/108, 123, 125, 554
See application file for complete search history.

(56) References Cited

U.S. PATENT DOCUMENTS 2,908,337 A 10/1959 Surprise et al.
4,704,045 A 11/1987 Taylor et al.
5,722,789 A 3/1998 Murray
6,877,818 B1 4/2005 Gaertner et al.
(Continued)

FOREIGN PATENT DOCUMENTS

AT 13989 U1 * 12/2014 ..... B23B 31/1071
CN 105369725 A * 3/2016 ..... E01C 23/088
(Continued)

OTHER PUBLICATIONS

European Patent Office office action for corresponding patent application No. 21158415, dated Jul. 26, 2021, 7 pages (not prior art).

*Primary Examiner* — Abby J Flynn
*Assistant Examiner* — Michael A Goodwin
(74) *Attorney, Agent, or Firm* — Lucian Wayne Beavers; Patterson Intellectual Property Law, PC

(57) ABSTRACT

An earth working machine includes a support structure and a working assembly mounted on the support structure so as to be rotatable about a drive axis. An assembly-side bearing configuration is connected to the working assembly and a structure-side bearing configuration is connected to the support structure. The assembly-side bearing configuration includes a driver configuration having a driver surface facing in a first circumferential direction and the structure-side bearing configuration includes a driver counterpart configuration having a driver counterpart surface facing in a second circumferential direction opposite to the first, the movement spaces of the driver surface and of the driver counterpart surface about the drive axis overlapping one another.

16 Claims, 8 Drawing Sheets

(56) References Cited

U.S. PATENT DOCUMENTS

| | | | | |
|---|---|---|---|---|
| 7,901,011 | B2 | 3/2011 | Holl et al. | |
| 8,118,369 | B2 | 2/2012 | Holl et al. | |
| 8,672,046 | B2 | 3/2014 | Connell | |
| 9,234,320 | B2 | 1/2016 | Abresch et al. | |
| 10,724,186 | B2 | 7/2020 | Berning et al. | |
| 10,724,187 | B2 | 7/2020 | Berning et al. | |
| 10,724,188 | B2 | 7/2020 | Berning et al. | |
| 2004/0232760 | A1 | 11/2004 | Porter | |
| 2014/0333116 | A1 | 11/2014 | Busley et al. | |
| 2014/0333118 | A1 | 11/2014 | Abresh et al. | |
| 2017/0138004 | A1 | 5/2017 | Berning et al. | |
| 2018/0002876 | A1* | 1/2018 | Hirman | E01C 23/088 |
| 2018/0340299 | A1* | 11/2018 | Berning | E01C 23/088 |
| 2018/0340301 | A1* | 11/2018 | Berning | E01C 23/088 |
| 2019/0024329 | A1 | 1/2019 | Avans et al. | |
| 2019/0186088 | A1 | 6/2019 | Bjorge et al. | |

FOREIGN PATENT DOCUMENTS

| | | | |
|---|---|---|---|
| DE | 3911947 | A1 | 2/1990 |
| DE | 4037448 | A1 | 5/1992 |
| DE | 19932396 | A1 | 2/2001 |
| DE | 102006015506 | B3 | 11/2007 |
| DE | 102012008252 | A1 | 10/2013 |
| DE | 102013208638 | A1 | 11/2014 |
| EP | 2350391 | A1 | 8/2011 |
| EP | 3406798 | A1 | 11/2018 |
| WO | 2010048967 | A1 | 5/2010 |

* cited by examiner

EARTH WORKING MACHINE HAVING A POSITIVE CONNECTION BETWEEN THE ROTATING WORKING ASSEMBLY AND ITS ROTARY BEARING

CROSS-REFERENCES TO RELATED APPLICATIONS

This application claims benefit of German Patent Application No. DE 10 2020 105 391.6, filed on Feb. 28, 2020, and which is hereby incorporated by reference in its entirety.

BACKGROUND OF THE INVENTION

1. Field of the Invention

The present invention relates to an earth working machine, such as for example a road milling machine, a recycler, a stabilizer or a surface miner, comprising a support structure and a working assembly mounted on the support structure so as to be rotatable about a drive axis relative to the support structure, the drive axis defining an axial direction along the drive axis, a radial direction orthogonal thereto and a circumferential direction about the drive axis, in a reference state ready for a rotation of the working assembly about the drive axis, the working assembly being rotatably mounted by a first rotary bearing on a first support structure area at a drive axial end and being rotatably mounted by a rotary bearing arrangement on a second support structure area at a retention axial end situated remotely from the drive axial end in the axial direction, the rotary bearing arrangement including a second rotary bearing, an assembly-side bearing configuration connected to the working assembly and a structure-side bearing configuration connected to the support structure, the retention axial end as the assembly-side bearing configuration having a configuration including one of a bearing stem and a bearing sleeve and the second support structure area as the structure-side bearing configuration having the respectively other configuration including the other of the bearing stem and the bearing sleeve, the bearing sleeve surrounding the bearing stem in the reference state, both the bearing stem as well as the bearing sleeve being situated rotatably about the drive axis relative to the second support structure area in the reference state, and the bearing stem and the bearing sleeve being designed to be axially removable from one another and thereby separable from one another for maintenance, refitting and assembly purposes.

The present invention furthermore relates to a support structure designed for connection to a machine frame of an earth working machine, implemented in particular as a milling drum housing, which has a plurality of connection configurations for the releasably designed connection to a machine frame of an earth working machine. The support structure comprises a working assembly that is mounted on the support structure so as to be rotatable about a drive axis relative to the support structure for the purpose of earth working and is otherwise designed as indicated in the previous paragraph.

2. Description of the Prior Art

An earth working machine of this type in the form of a road milling machine and a support structure of this type in the form of a milling drum housing are known from EP 3406798 A1 (U.S. Pat. No. 10,724,188).

The second support structure area of the known earth working machine, as a maintenance hatch or maintenance door of the milling drum housing, is swivable about a swivel axis that is essentially parallel to the yaw axis of the earth working machine in order to achieve, by swiveling the maintenance door, an accessibility of a milling drum accommodated in the milling drum housing or a drive configuration supporting the latter as components of a known working assembly. When the maintenance door is open, the milling drum may be pulled off axially from the drive configuration that supports it and may be replaced by another milling drum for example.

The bearing stem and the bearing sleeve are designed in such a way that when opening the maintenance door, the structure-side bearing configuration, in the known case a bearing sleeve, is axially pulled off the assembly-side bearing configuration, in the known case a bearing stem, with the swivel movement of the maintenance door. Due to the swivel movement, the movement of pulling the bearing sleeve off the bearing stem is not a pure axial relative movement, but rather the predominantly axial translatory component of the pull-off movement has superimposed on it an, in terms of absolute value, smaller radial translatory and a rotatory movement component of the bearing sleeve.

Because of the advantageously simple and quick separability of the structure-side and the assembly-side bearing configurations of the rotary bearing arrangement, the aforementioned bearing configurations in the reference state are coupled together only in frictionally engaged fashion for the joint rotary movement about the drive axis. In the earth working operation of the earth working machine, it is possible that in certain operating situations, in which there is a brief elevated radial load of the rotary bearing of the working assembly, for example when the working assembly begins to move and/or when the working assembly is applied to the ground to be worked and/or when changing an engagement depth of the working assembly orthogonal to the drive axis, loads on the rotary bearing arrangement become so elevated that an unwanted relative rotation occurs of the structure-side and the assembly-side bearing configuration relative to one another. A relative rotation occurring in this manner may produce unwanted increased wear on at least one of the bearing configurations.

SUMMARY OF THE INVENTION

It is therefore the objective of the present invention to improve the support of the working assembly on the rotary bearing arrangement having the bearing configurations designed to be separable from one another and thereby to avoid possible increased wear.

In one embodiment the present invention achieves this objective on an earth working machine of the type mentioned at the outset in that the working assembly comprises a driver configuration having a driver surface facing in a first circumferential direction about the drive axis and that the structure-side bearing configuration has a driver counterpart configuration having a driver counterpart surface facing in a second circumferential direction about the drive axis opposite to the first, the movement spaces of the driver surface and of the driver counterpart surface about the drive axis overlapping in the reference state.

In another embodiment the present invention achieves this objective using identical means on a support structure mentioned at the outset for such an earth working machine. Since the invention is implemented on the support structure of the earth working machine and the support structure may be connected to the earth working machine in a manner that is designed to be releasable, the subsequent description and refinement of the present invention applies both to the earth working machine as well as to the support structure by itself. The support structure is preferably a casing surrounding the working assembly on multiple sides such as for example a milling drum housing known per se, which comprises a milling drum or at least a drive configuration designed for releasable coupling to a milling drum supported so as to be rotatable about the drive axis. In principle, however, the support structure may be any structure that supports the first rotary bearing and the rotary bearing arrangement.

Unless in an individual case something different is expressly stated, the present invention is described in the reference state defined at the outset, in which the working assembly is ready to rotate about the drive axis.

The maintenance, refitting and assembly purposes, for which the bearing stem and the bearing sleeve are primarily axially removable from one another, concern a maintenance and/or refitting and/or an assembly of components other than the second rotary bearing of the rotary bearing arrangement. The second rotary bearing may comprise or be a roller bearing or a slide bearing. As already stated above, the maintenance, refitting and assembly purposes concern work on the working assembly, for example the disassembly of a milling drum from a drive configuration and/or the assembly of a milling drum on a drive configuration.

Due to the arrangement of the aforementioned driver configuration and driver counterpart configuration having surfaces facing in opposite circumferential directions about the drive axis, the driver surface and the driver counterpart surface, whose movement spaces about the drive axis overlap, the driver surface and the driver counterpart surface, and consequently the driver configuration and the driver counterpart configuration, cannot pass one another along a circumferential path about the drive axis. Thus, even when the driver surface and the driver counterpart surface are at a maximum distance from one another in the circumferential direction about the drive axis when connecting the structure-side and the assembly-side bearing configurations of the rotary bearing arrangement, only a relative rotation of the two bearing configurations of less than one complete revolution is possible before the driver surface comes to engage the driver counterpart surface and the bearing configurations of the rotary bearing arrangement turn about the drive axis synchronously, and without relative turning, due to the positive engagement thus achieved. If a relative rotation of less than 360° is desired, it is possible to provide multiple driver configurations and/or driver counterpart configurations distributed over the circumference. To ensure a uniform load on the configurations, a refinement of the present invention provides for arranging just as many driver configurations as driver counterpart configurations. Preferably, a plurality of driver configurations and/or driver counterpart configurations is arranged in the circumferential direction at equal distances about the drive axis so that, when establishing the reference state, it is not necessary to mind the relative orientation of the driver configurations and the driver counterpart configurations relative to one another. For reasons of the preferred equidistant arrangement, the angular distance between two adjacent driver configurations and, respectively, driver counterpart configurations is an integral fraction of 360°.

The movement space of a surface is in this instance the space that is traversed by a surface, driver surface or driver counterpart surface, during a rotation about the drive axis.

Since normally the path of the drive torque runs from the working assembly to the structure-side bearing configuration and since further the working assembly is normally drivable only in one direction for rotation, the first circumferential direction, in which the driver surface faces, is the circumferential direction in which the working assembly is drivable for rotation.

The earth working machine preferably has a drive motor as the rotary drive of the working assembly, from which a drive torque is transmittable onto the working assembly. For driving the working assembly at a suitable rotational speed or in a suitable rotational speed range, at least one gear unit, in particular a planetary gear set, may be provided in the torque transmission path from the drive motor to the working assembly. The drive train from the drive motor to the working assembly may include a traction drive, in particular a belt drive, and the aforementioned planetary gear set, in light of space considerations preferably in the aforementioned sequence along the torque transmission path. For providing sufficient hydraulic energy, a pump power take-off gear may be additionally situated in the drive train, preferably between the drive motor and the traction drive. The final gear in the torque transmission path from the drive motor to the working assembly, in particular the aforementioned planetary gear set, may be situated, at least in sections, in a drive configuration permanently rotatably mounted by the first rotary bearing of the support structure.

As planetary gear set, the gear unit itself may include the first rotary bearing. A first part of the transmission housing may be fixed in place on the support structure and a second part of the transmission housing may be mounted on the first transmission housing part so as to be able to rotate about the drive axis relative to the first transmission housing part. The second transmission housing part may be coupled in a torsionally fixed manner to the drive configuration and/or be part of the drive configuration.

The first rotary bearing is therefore preferably a so-called locating bearing of the rotary bearing of the working assembly. As a locating bearing, the first rotary bearing has no axial clearance of motion relative to the components connected to it: the first support structure area and the working assembly. The locating bearing normally remains unchanged on the earth working machine or on the support structure over its operational life except for unavoidable wear. The rotary bearing arrangement by contrast is formed by a non-locating bearing of the rotary bearing arrangement of the working assembly, which is designed to allow for an axial relative movement between the second support structure area and the working assembly. The rotary bearing arrangement is even designed for repeated separation and reconnection of its aforementioned bearing configurations.

The structure-side bearing configuration is preferably the bearing sleeve. In order to keep the number of components low, the bearing sleeve may in principle be the inner ring of the second rotary bearing, which preferably takes the form of a roller bearing, even if this is not preferred due to the great hardness and the associated poor machinability of a roller bearing inner ring. The structure-side bearing configuration is preferably a bearing sleeve supported directly or indirectly by an inner ring of the second rotary bearing, which is preferably embodied as a roller bearing. To make it possible, preferably by a swivel movement of the second support structure area, to slide the bearing sleeve onto the bearing stem forming the assembly-side bearing configuration and to pull the bearing sleeve off the latter, the bearing sleeve is preferably designed to have a clearance tapering in the direction away from the drive axial end. The bearing sleeve is thus preferably roughly funnel-shaped. For the same reasons, the bearing stem preferably forming the assembly-side bearing configuration is preferably designed to taper in the direction of its protruding longitudinal end.

The second rotary bearing is functionally situated preferably between the second support structure area on the one hand and the two bearing configurations on the other hand so that both bearing configurations are able to rotate relative to the second support structure area.

In order to be able to avoid, during an earth working operation, unwanted ancillary forces between the driver configuration and the driver counterpart configuration having components orthogonal to a virtual circumferential circular path passing through a contact area of driver surface and driver counterpart surface, at least one surface of the driver surface and the driver counterpart surface is preferably designed to be flat. The flat surface preferably lies in a plane containing the drive axis such that it is always oriented orthogonally to its path of movement during a rotation about the drive axis. The respectively other surface of the driver surface and the driver counterpart surface may have a convexly curved shape resting on the flat surface, for example as a spherical calotte or ellipsoid calotte, or, and this is preferred for reasons of simple fabrication as well as to keep the surface pressure as low as possible, it may also be flat. To avoid unwanted high loads due to surface pressures at the contact point between the driver surface and the driver counterpart surface, the driver surface and the driver counterpart surface preferably abut in planar fashion in the abutting engagement, that is, they are parallel to one another in the abutting engagement. For this reason, the respectively other flat surface of the driver surface and the driver counterpart surface preferably also lies in a plane containing the drive axis.

Although it is possible that immediately following the establishment of a connection of the bearing configurations with one another along a circumferential circular path about the drive axis there may be a distance between the driver surface and the driver counterpart surface, an operating situation is preferred in which the driver surface and the driver counterpart surface are in an abutting engagement that transmits force in the circumferential direction. If it does not exist from the outset, this operating situation advantageously sets in by itself if there is a relative rotation between the aforementioned bearing configurations.

For securely establishing the above-described torque-transmitting abutting engagement between the driver surface and the driver counterpart surface, the driver counterpart configuration may have a depression into which a projection of the driver configuration engages. Alternatively, the driver counterpart configuration may have a projection, which is in, or may be brought into, an abutting engagement with a projection or a depression of the driver configuration. As a further alternative, the driver counterpart configuration may have both a depression as well as a projection, for example if the driver counterpart surface is formed on a separate projection component, which is inserted into a depression of the structure-side bearing configuration in order to anchor the projection component with the driver counterpart surface on the structure-side bearing configuration in a maximally durable and fixed fashion. The projection component with the driver counterpart surface may then project out from the depression beyond the surrounding surface of the bearing configuration.

The driver counterpart configuration as a projection or a depression may be formed in one piece with the structure-side bearing configuration, for example by primary forming fabrication with possible subsequent postprocessing or as a depression using only a respective machining process. In a more flexible manner and especially more suitable for retrofitting, the driver counterpart configuration may be connected as a projection component with the bearing configuration by a jointing process. Thus, the driver counterpart configuration may be connected to the bearing configuration in integral fashion, in particular by welding, possibly also by soldering or adhesive bonding, which results in a very high connection stability. Alternatively, a projection component forming the driver counterpart configuration or being comprised by the driver counterpart configuration, which comprises the driver counterpart surface, may be designed to be releasably connected to the bearing configuration, for example by bolting, so that when reaching a predetermined state of wear the projection component comprising the driver counterpart surface may be replaced with a non-worn projection component.

A high transmittable torque and a simple exchangeability of the driver counterpart surface may be achieved if the driver counterpart configuration has a projection, in particular a projection component, which is inserted into a depression in the structure-side bearing configuration and is fixated there in a manner that is designed to be releasable. Preferably, the projection or the projection component is connected to the structure-side bearing configuration in a firm, but at the same time releasable connection by bolting.

What was said above regarding the driver counterpart configuration also applies by analogy to the driver configuration. The latter may also comprise a projection and/or a depression. Accordingly, the driver configuration may also comprise a projection component, which is accommodated in a depression of the component supporting it, in order to be able to transmit a torque that is as high as possible from the—normally driving—driver configuration to the—normally driven—driver counterpart configuration.

The driver configuration may also be connected to the component supporting it in a manner that is designed to be releasable, that is, for example by bolting, or that is designed not to be releasable, that is, for example by welding, soldering, adhesive bonding and the like.

An essential difference between the driver configuration and the driver counterpart configuration is that the driver counterpart configuration is situated on the structure-side bearing configuration in order to rotate the latter synchronously with the working assembly, whereas the driver configuration does not necessarily have to be situated on the assembly-side bearing configuration, but may be situated at any suitable location on the working assembly for jointly moving with the latter. Of course, the driver configuration may be situated on the assembly-side bearing configuration.

As was already explained above, the working assembly may comprise a drive configuration, which is supported at the drive axial end by the first rotary bearing in the first support structure area so as to be able to rotate about the drive axis and which protrudes axially away from the first support structure area. A working apparatus such as a milling drum, for example, may be slid axially onto the drive configuration from the side of the retention axial end and connected to the drive configuration for joint rotation. In the same way, the working apparatus may be axially pulled off or pushed off the drive configuration in the opposite direction.

The working assembly may comprise only the drive configuration.

Since the drive configuration is permanently rotatably mounted in the first support structure area, it is advantageous if the drive configuration supports the driver configuration. The driver configuration is thus always present on the support structure and consequently on the earth working machine comprising the support structure.

Normally, in the reference state, the second support structure area is situated axially at a distance from the longitudinal end of the drive configuration that protrudes from the first support structure area. In order to be able to ensure, using little constructional effort, that the driver surface of a driver configuration situated on the drive configuration is able to come into a torque-transmitting engagement with the driver counterpart surface of the structure-side bearing configuration, it is advantageous if the drive configuration has an end face facing in the axial direction on its longitudinal end situated remotely from the first rotary bearing, the end face bearing the driver configuration. On the one hand, such an end face provides a sufficiently large area for situating a driver configuration. On the other hand, the end face, or an end face component comprising the end face, may be designed with sufficient stability for transmitting the required torques.

The end face is preferably situated orthogonally to the drive axis, although this is not necessary. The end face facing in the axial direction may also be designed to be stepped and/or conical from the drive axis radially outward, the half opening angle of the end face cone being preferably greater than 45° so as to avoid the end face having too great of an axial extension. Even then the end face still points primarily in the axial direction.

The drive configuration may comprise a tubular section, in particular a cylindrical section, whose tube or cylinder axis is the drive axis. At least a portion of the aforementioned gear unit may be situated in at least one part of this tubular section, preferably in a tubular section situated closer to the first support structure area than to the second support structure area.

On its protruding longitudinal end situated remotely from the first rotary bearing, the cylindrical section may be covered partially or preferably completely by an end face component so that the drive configuration preferably comprises a pot-like configuration, whose bottom is formed by the end face component.

As was already explained above, the drive configuration is designed to fulfill various working tasks, preferably to accommodate a milling drum in a releasably designed manner. Thus, the drive configuration is able to accommodate in temporal succession a plurality of milling drums, which differ with respect to the type and/or number and/or arrangement of the earth material-removing milling bits situated thereon. Thus, the working assembly may comprise the working configuration and the milling drum.

In order to avoid a relative rotation between the drive configuration and the milling drum accommodated by it, the drive configuration preferably has projecting transmission components, which are designed for the physical transmission of torque onto a milling drum situated on the drive configuration. Normally, torque is introduced from a drive motor of the earth working machine into the drive configuration at the drive axial end. If the milling drum is situated on the drive configuration and the working assembly comprises both the drive configuration as well as the milling drum, the torque transmission path runs within the working assembly from the drive configuration to the milling drum.

In order to keep the number of components of the working assembly as low as possible, preferably at least one of the transmission components comprises the driver configuration.

In the reference state, in particular in a reference state ready for earth working, a milling drum accommodated on the drive configuration and the drive configuration are situated coaxially. The milling drum comprises a milling drum tube, which surrounds the drive configuration radially outside. For a transmission of torque from the drive configuration to the milling drum that is as simple and secure as possible, the milling drum preferably juts out beyond the drive configuration on the longitudinal end of the drive configuration situated remotely from the drive axial end.

If the first rotary bearing is situated between the aforementioned two transmission housing parts, it is possible, for the purpose of achieving a great axial working width, for the milling drum to surround the first rotary bearing radially on the outside and to jut out beyond it in the direction away from the retention axial end.

A plurality of milling bit holders is situated on the outside of the milling drum tube, which milling bit holders are designed to accommodate milling bits. The milling bit holders are preferable designed as milling bit exchange holders having a tube-side holder component permanently situated on the milling drum tube and having a holder exchange component designed to be connected to the holder component in releasable fashion. Due to the high degree of wear to which milling bits are subject in earth working operation, the milling bits are also situated in the respective milling bit holder so as to be exchangeable. The milling bit holders are preferably arranged in spiral-shaped fashion on the milling drum tube so as to support the conveyance of removed earth material away from the working assembly.

The milling drum is preferably supported on the drive configuration on its longitudinal end situated closer to the drive axial end. This is possible there in a particularly simple and stable manner since the drive configuration at the drive axial end is supported in the support structure area and thus has a high support stiffness in that location due to the slight length of the axial protrusion from the first support structure area. For a further support of the milling drum on the drive configuration at an axial distance from the first-mentioned support, the milling drum may have at the retention axial end preferably a connecting structure running transverse to the drive axis. In the reference state, the connecting structure is preferably situated axially adjacent to the aforementioned end face so as to allow for a greatest possible bearing distance between the two support points of the milling drum. The end face of the drive configuration may comprise for example an axially protruding centering stem on which the milling drum is supported via the connecting structure in a positive fitting centered manner.

The aforementioned driver configuration supported by the drive configuration may extend axially past the connecting structure or through the connecting structure and thus protrude beyond the connecting structure to the structure-side bearing configuration. Preferably, the driver configuration extending past the connecting structure or through the latter is developed on the aforementioned transmission component. Thus, a section of the transmission component that axially overlaps with the connecting structure is able to transmit torque from the drive configuration to the milling drum and a section of the transmission component, which extends axially beyond the connecting structure to the second support structure area, is able to form the driver configuration and transmit torque onto the structure-side bearing configuration. The driver configuration is preferably an axial end of a transmission component protruding axially from the drive configuration. Such a transmission component may be embodied for example by a protruding bolt or stem. This transmission component, and the associated driver configuration, is preferably also mounted on the drive configuration in a manner designed to be releasable, for example by a bolt, in particular by a bolt passing centrally through the transmission component.

Additionally or as an alternative to the drive configuration, it is possible for the milling drum to support the driver configuration. Since the milling drum as a separate unit may be connected to the drive configuration and may be released from the latter, the present application also relates to a milling drum, as it is described and developed in this application, including a driver configuration.

If the milling drum supports the driver configuration, or at least also supports a driver configuration, the driver configuration may be situated on the aforementioned connecting structure. The connecting structure, which preferably runs transversely, as described above, particularly preferably orthogonally, to the drive axis, may connect the milling drum tube with the assembly-side bearing configuration. The assembly-side bearing configuration is preferably a bearing stem, which on the side facing away from the drive axial end protrudes axially in the direction away from the drive axial end. On the side of the connecting structure facing the drive axial end, a recess may be formed in the area of the bearing stem, into which the aforementioned centering stem of the end face of the drive configuration projects in the reference state.

The working assembly may comprise at least one retention device, for example one or several retaining bolts, by which the milling drum is retained on the drive configuration in the reference state. In order to be able to accommodate the milling drum on the drive configuration in a manner designed to be releasable, the at least one retention device is also accommodated on the remaining working assembly in a manner designed to be releasable. The driver configuration may be situated or developed on the retention device, in particular as a retaining bolt. If the retention device, in addition to a retaining bolt, comprises a washer fixated by the retaining bolt on the drive configuration and/or on the milling drum in the reference state, the driver configuration may be situated or developed, alternatively or additionally, on the washer.

In order to keep the number of components for forming the working assembly small, the retention device preferably comprises a retaining bolt, which is screwed into the aforementioned centering stem of the drive configuration in such a way that its bolt axis is coaxial with respect to the drive axis in the reference state.

In particular if the driver configuration is developed on the retention device, the driver counterpart configuration may be developed on a component developed separately of the bearing sleeve or an inner ring of the second rotary bearing, which is preferably releasably connected to the bearing sleeve or an inner ring of the second rotary bearing.

The working assembly includes all those components, which on the basis of the reference state are still connected to the drive configuration after the bearing sleeve has been pulled off from the bearing stem.

In contrast to the case discussed above, in which the driver configuration and the driver counterpart configuration are at a distance from one another in the circumferential direction about the drive axis when establishing the reference state, the case may also occur that the driver configuration and the driver counterpart configuration overlap with one another in the circumferential direction when establishing the reference state. In this case, this overlap may either prevent the establishment of the reference state as a physical barrier or the forceful attempt to establish the reference state may damage at least one of the mentioned aforementioned configurations. In order to avoid these disadvantageous consequences for the earth working machine or the support structure in the case of an overlap, there may be a provision for the driver configuration to have an alignment surface axially facing away from the drive axial end in the reference state and for the driver counterpart configuration to have an alignment counterpart surface facing axially toward the drive axial end in the reference state. The alignment surface is inclined with respect to a reference surface orthogonal to the drive axis in such a way that the alignment surface approaches the drive axial end with increasing circumferential distance from the driver surface along the second circumferential direction. The alignment counterpart surface is inclined with respect to the reference surface orthogonal to the drive axis in such a way that the alignment counterpart surface recedes from the drive axial end with increasing circumferential distance from the driver counterpart surface along the first circumferential direction. In the aforementioned case of overlap, the driver configuration and the driver counterpart configuration are able to slide past one another along their alignment surface and alignment counterpart surface by relative rotation until an axial approach of the second bearing configuration to the first bearing configuration is possible to such a degree that the reference state can be established. Under axial pressure, the alignment surface and the alignment counterpart surface force a short relative screw movement with the drive axis as screw axis upon the working assembly and the structure-side bearing configuration.

If the inclination of the surfaces, the alignment surface and the alignment counterpart surface, with respect to the reference surface is sufficiently great, no self-locking occurs, but rather, by the process of connecting the structure-side and the assembly-side bearing configurations by axial approach to one another, the working assembly and the structure-side bearing configuration are moved relative to one another out of the initially existing overlap situation. For this purpose, it is advantageous if the alignment surface is inclined with respect to the reference surface by an angle of at least 25°, preferably of at least 30°, and/or if the alignment counterpart surface is inclined with respect to the reference surface by an angle of at least 25°, preferably of at least 30°. In order to provide an abutment that is as planar as possible and has a low surface pressure between the alignment surface and the alignment counterpart surface, the angles of inclination of the alignment surface and the alignment counterpart surface are preferably equal in terms of absolute value.

As was already explained at the outset with respect to the related art, according to the present invention, the second support structure area together with the structure-side bearing configuration starting from the reference state is also swivable about a swivel axis, which is at least inclined, preferably orthogonal, with respect to the drive axis, away from the first support structure. To avoid effects of gravity on a swivel movement, the swivel axis preferably runs parallel to a yaw axis of the earth working machine extending in the vertical earth working machine direction. The swivel axis is preferably inclined by no more than 15° with respect to the yaw axis. The second support structure area is preferably developed as a maintenance door of a casing surrounding the working assembly at least for the most part, such as a milling drum housing for example.

Although the support structure may be provided on a construction site in the reference state in order to be connected to a machine frame of an earth working machine, in the reference state the support structure is preferably connected to such a machine frame. The connection of the support structure to the machine frame is preferably designed to be releasable, for example by bolting and/or actuated locking by at least one actuator-operated positive locking component, in order to facilitate the maintenance and, if necessary, repair of the support structure. It is also possible, however, for the support structure to be connected to the machine frame in a manner designed to be unreleasable, for example by welding.

BRIEF DESCRIPTION OF THE DRAWINGS

The present invention will be explained in greater detail below with reference to the enclosed figures. The figures show.

DETAILED DESCRIPTION

Figure 1:
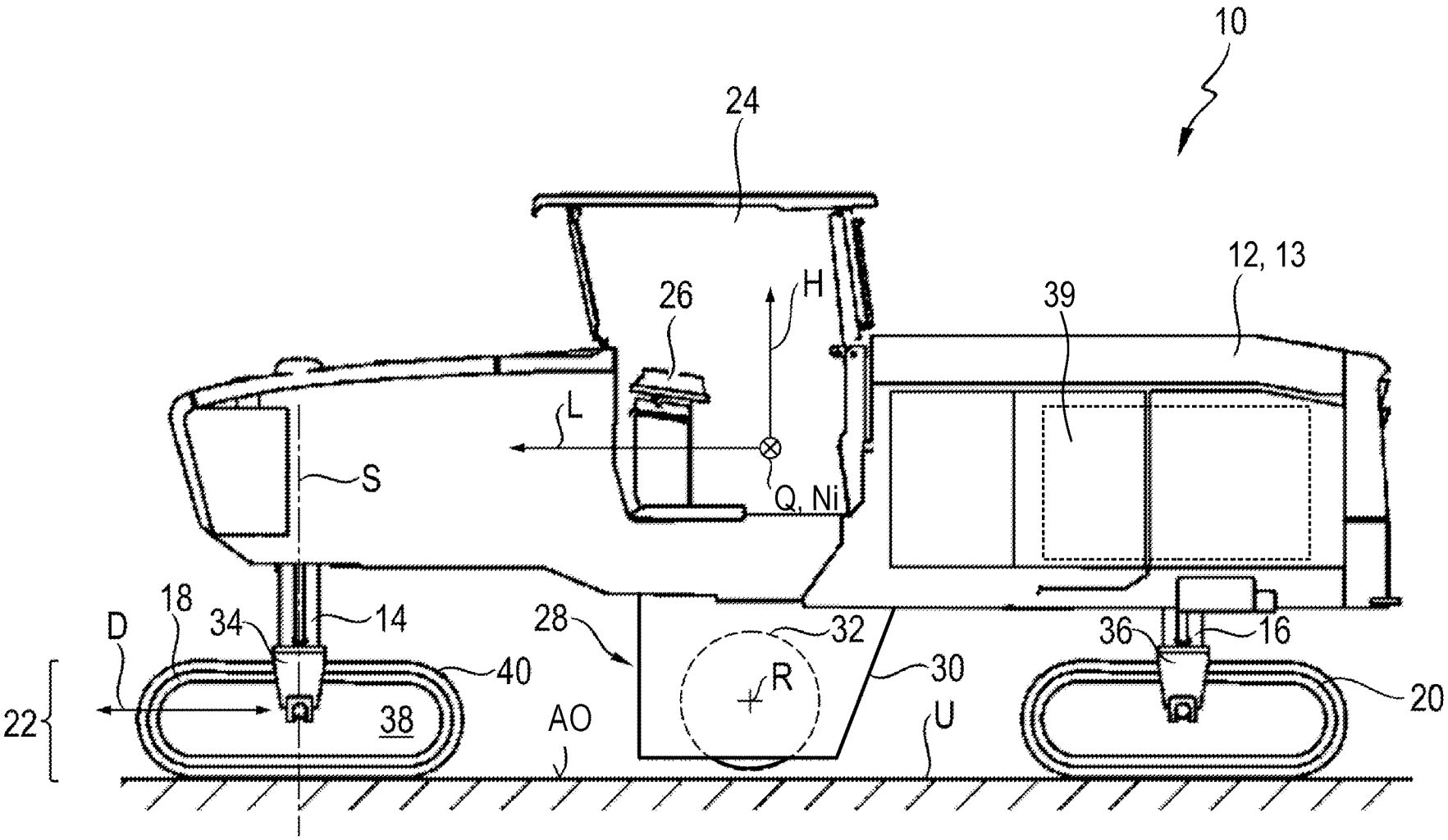
FIG. 1 a rough schematic side view of a specific embodiment according to the invention of an earth working machine in the form of a large milling machine, FIG. 2 a schematic longitudinal sectional view through the support structure and the working assembly of the earth working machine from FIG. 1 in an operational state for earth working, the sectional plane including the drive axis of the working assembly, FIG. 3 an enlarged partial longitudinal sectional representation of the right longitudinal end in FIG. 2 of the working assembly comprising a drive configuration and a milling drum, FIG. 4 a perspective view of the drive configuration of FIGS. 2 and 3, FIG. 5 a top view onto the drive configuration from FIG. 4 in the direction of view orthogonal to the drive axis, FIG. 6 a perspective view of a transmission component including driver configuration, in engagement with a driver counterpart configuration on the bearing sleeve from FIGS. 2 and 3, FIG. 7 a top view onto the bearing sleeve transmission component from FIG. 6 in the direction of view along the vertical machine direction, orthogonal to the drive axis, and FIG. 8 a perspective view of a connecting structure and a bearing sleeve of a second specific embodiment of the invention of an earth working machine and a support structure of the present application.

In FIG. 1, a first specific embodiment according to the invention of an earth working machine in the form of an earth or road milling machine is generally indicated by reference numeral 10. It comprises a machine frame 12, which forms the basic framework for a machine body 13. Machine body 13 comprises machine frame 12 and the components of machine 10 which are connected to the machine frame and are, if indicated, movable relative thereto.

Machine body 13 comprises front lifting columns 14 and rear lifting columns 16, which are connected at one end to machine frame 12 and at the other end respectively to front drive units 18 and to rear drive units 20. The distance of machine frame 12 from drive units 18 and 20 is modifiable by way of lifting columns 14 and 16.

Drive units 18 and 20 are depicted by way of example as crawler track units. In a departure therefrom, individual, or all, drive units 18 and/or 20 may also be wheel drive units.

The viewer of FIG. 1 is looking toward the earth working machine (or simply "machine") 10 in transverse machine direction Q that is orthogonal to the drawing plane of FIG. 1. A longitudinal machine direction orthogonal to transverse machine direction Q is labeled L and extends parallel to the drawing plane of FIG. 1. A vertical machine direction H likewise extends parallel to the drawing plane of FIG. 1 and orthogonally to longitudinal and transverse machine directions L and Q. The arrowhead of longitudinal machine direction L in FIG. 1 points in the forward direction. Vertical machine direction H extends parallel to the yaw axis of machine 10, longitudinal machine direction L extends parallel to the roll axis, and transverse machine direction Q extends parallel to pitch axis Ni.

Earth working machine 10 may comprise an operator's platform 24, from which a machine operator is able to control machine 10 via a control panel 26.

Arranged below machine frame 12 is a working assembly 28, here represented, for example, as a milling assembly 28 having a milling drum 32, accommodated in a milling drum housing 30, that is rotatable about a milling axis R extending in transverse machine direction Q so that substrate material may be removed therewith during an earth working operation, starting from contact surface AO of substrate U to a milling depth determined by the relative vertical position of machine frame 12. Milling drum 32 is therefore a working apparatus within the meaning of the present application. The milling drum housing 30 releasably connected to machine frame 12 forms a support structure within the meaning of the present invention.

The vertical adjustability of machine frame 12 by way of lifting columns 14 and 16 also serves to set the milling depth, or generally working depth, of machine 10 in the context of earth working. Earth working machine 10 depicted by way of example is a large milling machine, for which the placement of working assembly 28 between the front and rear drive units 18 and 20 in longitudinal machine direction L is typical. Large milling machines of this kind, or indeed earth-removing machines in general, usually comprise a transport belt so that removed earth material can be transported away from machine 10. In the interest of better clarity, a transport belt that is also present in principle in the case of machine 10 is not depicted in FIG. 1.

It is not apparent from the side view of FIG. 1 that machine 10 comprises, in both its front end region and its rear end region, two respective lifting columns 14 and 16 each having a drive unit 18, 20 connected to it. Front lifting columns 14 are respectively connected to drive units 18, in a manner also known per se, by a drive unit connecting structure 34, for example a connecting fork fitting around drive unit 18 in transverse machine direction Q. Rear lifting columns 16 are connected to their respective drive unit 20 via a drive unit connecting structure 36 constructed identically to drive unit connecting structure 34. Drive units 18 and 20 are of substantially identical construction, and constitute propelling unit 22 of the machine. Drive units 18 and 20 are motor-driven, normally by a hydraulic motor (not depicted).

The driving force source of machine 10 is an internal combustion engine 39 accommodated on machine frame 12. In the depicted exemplary embodiment, milling drum 32 is rotationally driven by internal combustion engine 39. The output of internal combustion engine 39 furthermore provides a hydraulic pressure reservoir on machine 10, which makes it possible to operate hydraulic motors and hydraulic actuators on the machine. Internal combustion engine 39 is thus also the source of the propulsive force of machine 10.

In the example depicted, drive unit 18, having a travel direction indicated by double arrow D, comprises a radially inner accommodation and guidance structure 38 on which a circulating drive track 40 is arranged and is guided for circulating movement.

Lifting column 14, and with it drive unit 18, is rotatable about a steering axis S by way of a steering apparatus (not further depicted). Preferably additionally, but also alternatively, lifting column 16, and with it drive unit 20, may be rotatable by way of a steering apparatus about a steering axis parallel to steering axis S.

Figure 2:
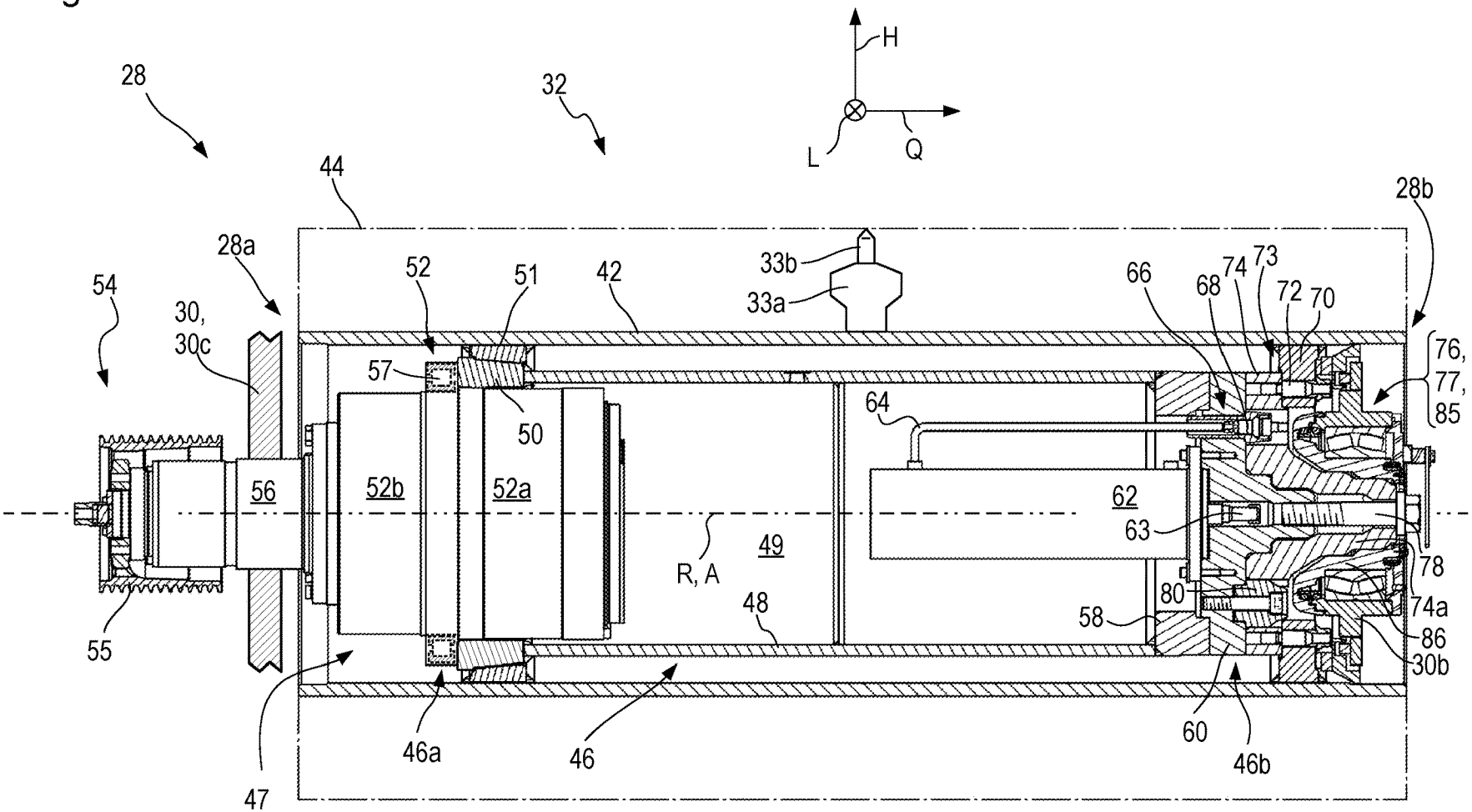

FIG. 2 shows a longitudinal sectional view of working assembly 28 together with milling drum 32 from FIG. 1 in a sectional plane containing rotation axis R of the milling drum. FIG. 2 also shows portions of milling drum housing 30.

Milling drum 32 comprises a substantially cylindrical milling drum tube 42, on whose radially outer side bit holders or bit exchange holders 33*a*, having milling bits 33*b* exchangeably accommodated therein, are provided in a manner known per se. Of these, only one example is respectively depicted for illustration. A dot and dash line 44 indicates the effective diameter (circular cylinder section) of milling drum 32, defined by the milling bit tips of the milling bits 33*b*.

Working assembly 28 comprises a drive configuration 46 having an internal tube 48, a support cone 50, and part 52*a*, rotatable relative to machine frame 12, of a transmission housing 52. Support cone 50 and internal tube 48 are connected to one another, and are connected as an assembly to transmission housing part 52*a* for joint rotation about drive axis A of drive configuration 46. In the reference state of working assembly 28, drive axis A of drive configuration 46 and rotation axis R of milling drum 32 are coaxial.

In FIG. 2, working assembly 28 is in a reference state ready for rotation about drive axis A. For this purpose, milling drum 32 is connected to drive configuration 46 of working assembly 28 in torque-transmitting fashion. Milling drum 32 surrounds drive configuration 46 radially on the outside.

A planetary gear set that steps speed down and steps torque up is accommodated in a transmission housing 52. The right (in FIG. 2) part 52*a* of transmission housing 52, which is jointly rotatable with internal tube 48, is coupled to a ring gear of a planetary gear set for joint rotation. A left (in FIG. 2) part 52*b* of transmission housing 52 is a support structure-mounted and hence machine frame-mounted part of machine body 13.

Milling drum tube 42 is braced against support cone 50 of drive configuration 46 by a negatively conical counterpart support cone 51.

Drive configuration 46 is furthermore connected to a drive torque-transmitting arrangement 54 which, in the example depicted, encompasses inter alia a belt pulley 55. Belt pulley 55 is connected to an input shaft (not depicted in FIG. 2) of the planetary gear set in transmission housing 52. The input shaft, connected to belt pulley 55 for joint rotation, extends through a shaft tunnel 56 that is support structure-mounted in the exemplary embodiment depicted and is rigidly connected to transmission housing part 52*b*.

Together with the support structure-mounted assembly made up of transmission housing part 52*b* and shaft tunnel 56, drive configuration 46 forms a drive assembly 47 that protrudes axially into milling drum 32 from a drive axial end 28*a* of working assembly 28. Milling drum 32 preferably protrudes axially on both sides beyond drive configuration 46 as that part of drive assembly 47 which is rotatable relative to milling drum housing 30 as the support structure and hence to machine frame 12.

Drive assembly 47, and with it drive configuration 46, is supported on a first support structure area 30*c* of milling drum housing 30 in the area of shaft tunnel 56. More precisely, drive configuration 46 together with rotatable transmission housing part 52*a* is supported on machine frame-mounted transmission housing part 52*b* and hence on first support structure area 30*c* by a first rotary bearing 57 situated between rotatable transmission housing part 52*a* and machine frame-mounted transmission housing part 52*b*. First rotary bearing 57 is depicted in FIG. 2 merely by dot and dash line and symbolically. First rotary bearing 57 forms a locating bearing of drive configuration 46. The axial longitudinal end 46*a*, located closer to belt pulley 55, of drive configuration 46 is therefore also referred to as the locating bearing-side longitudinal end 46*a*.

Milling drum 32 extends axially along its rotation axis (milling axis) R, which coincides with drive axis A in the operational state, between drive axial end 28*a* located closer to drive torque-transmitting arrangement 54 in FIG. 2 and a retention axial end 28*b* of drive assembly 28, located oppositely from the drive axial end 28*a*. At retention axial end 28*b*, milling drum 32 in the reference state is retained in its position on drive configuration 46 by a central retaining bolt 78. Retaining bolt 78 is part of working assembly 28.

At the non-locating bearing-side longitudinal end 46*b* located axially oppositely from locating bearing-side longitudinal end 46*a*, drive configuration 46 comprises a support ring 58 and an end-side cover 60 connected to support ring 58 as an end face component of the present application. In the exemplary embodiment depicted, support ring 58 is connected to internal tube 48 by welding. Cover 60 may likewise be welded, or alternatively bolted, onto support ring 58. It is connected to support ring 58 and to internal tube 48 for joint rotation about drive axis A.

Support ring 58 and the radially external areas of cover 60 may be embodied in a variety of ways. Their shape is not of essential importance. It is also conceivable to omit support ring 58 and to connect cover 60 directly to internal tube 49, in particular by welding.

In the exemplary embodiment depicted in FIG. 2, a hydraulic cylinder 62, which is arranged with its hydraulic cylinder axis coaxial with drive axis A of drive configuration 46, is accommodated in interior 49 of drive configuration 46. Hydraulic cylinder 62 may be supplied with hydraulic fluid by way of a hydraulic connector line 64 through an energy passthrough opening 66 in cover 60.

Hydraulic connector line 64 ends, at its longitudinal end located remotely from hydraulic cylinder 62, in a coupling configuration 68 that is connectable, in order to supply hydraulic cylinder 62, to a counterpart coupling configuration of a supply line (not depicted) so that piston rod 63 may be extended from hydraulic cylinder 62 and retracted back into it. Two hydraulic connector lines 64 may be provided in order to operate a preferred double-acting hydraulic cylinder, one for each movement direction of piston rod 63.

After the central retaining bolt 78 provided for axial positional retention of milling drum 32 on drive configuration 46 has been released, using piston rod 63 milling drum 32 may be axially pushed away from drive configuration 46 for deinstallation or pulled onto drive configuration 46 for installation.

A connecting ring 70 is arranged radially internally on milling drum tube 42 in a region located closer to retention axial end 28*b*, and is connected, by way of a welded joint in the example depicted, to milling drum tube 42 for joint rotation.

In the exemplary embodiment, milling drum tube 42 is rigidly connected to a connecting flange 74 via connecting ring 70 by threaded bolts 72. Connecting ring 70 and connecting flange 74 together form a connecting structure 73 of milling drum 32 mentioned in the introductory part of the specification.

Provided on connecting flange 74, bolted or welded thereto or preferably formed in one piece with connecting flange 74, is a bearing stem 74*a* which, starting from a connecting region of connecting flange 74 with connecting tube 70, protrudes axially toward retention axial end 28*b*, or away from drive axial end 28*a*.

Deviating from the depicted exemplary embodiment, if dimensioned accordingly, the connecting flange may be connected, in particular welded, directly to the milling drum tube without a connecting ring.

Additionally or alternatively, deviating from the depicted exemplary embodiment, the bearing stem may be formed separately from the connecting flange and be attached to the latter, in particular releasably bolted to it.

In the operational state of milling drum 32, a second rotary bearing 76 supporting drive configuration 46 for rotation about drive axis A is situated on bearing stem 74*a* for the formation of a non-locating bearing of the rotary bearing. In the depicted exemplary embodiment, both rotary bearings 57 and 76 are designed as roller bearings.

Together with bearing stem 74*a* and a bearing sleeve 86 situated on the inner ring of second rotary bearing 76, second rotary bearing 76 is part of a rotary bearing arrangement 77. Bearing stem 74*a* is an assembly-side bearing configuration and bearing sleeve 86 is a structure-side bearing configuration of rotary bearing arrangement 77. Together with bearing sleeve 86, second rotary bearing 76 forms a rotary bearing assembly 85 that is only movable jointly in normal operation.

Second rotary bearing 76 may be accommodated for example in a side panel or side door 30*a* (see FIG. 3) as a second support structure area. Side door 30*a* is part of milling drum housing 30 and is end-located axially oppositely from milling drum 32 at retention axial end 28*b*. FIG. 2 shows only one component 30*b*, rigidly connected to such a side door 30*a* as the second support structure area, as a bearing surface for the outer bearing ring of second rotary bearing 76.

Side door 30*a* is preferably provided pivotably on machine frame 12 so that drive configuration 46 and/or milling drum 32 in the interior of milling drum housing 30 may be made accessible by simply pivoting open and closed. Side door 30*a* is preferably pivotable about a pivot axis parallel to vertical machine direction H, since the pivoting of side door 30*a* then does not need to occur against gravity in any pivoting direction. Rotary bearing assembly 85 is preferably supported on side door 30*a* in such a way that rotary bearing assembly 85 is pivotable together with side door 30*a*. Opening side door 30*a* causes rotary bearing assembly 85, that is, second rotary bearing 76 together with bearing sleeve 86, to be pulled axially off bearing stem 74*a*.

Preferably, the distance of the side door pivot axis from side door 30*a* is greater than the radius of the circular cylinder section of milling drum 32 shown in FIG. 2, so that the circular path of rotary bearing assembly 85 when pivoting together with side door 30*a* has the largest possible radius and thus the least possible curvature. This makes it easier to pull rotary bearing assembly 85 off bearing stem 74*a* and to slide rotary bearing assembly 85 onto bearing stem 74*a*.

Figure 3:
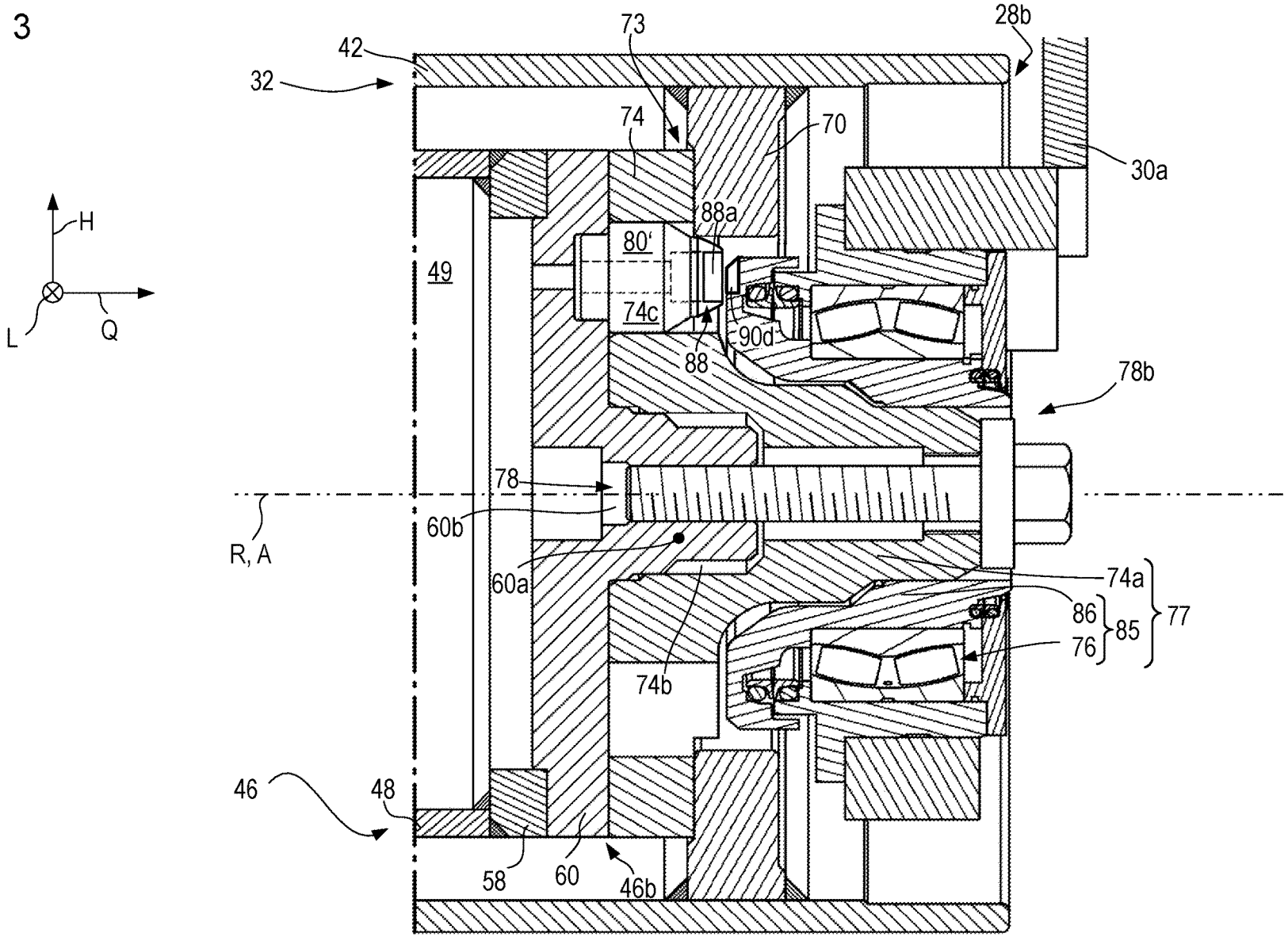

In FIG. 3, support ring 58, cover 60, and connecting flange 74 have shapes that deviate slightly from the depiction in FIG. 2. The shapes of the aforementioned components do not, however, differ sufficiently from the depiction in FIG. 2 for those differences to have an influence on the implementation of the present invention.

Hydraulic cylinder 62, with its piston rod 63, is omitted from FIG. 3 for the sake of clarity. Threaded bolts 72 for connecting flange 74 to connecting ring 70 are also not depicted for the sake of clarity.

Embodied on cover 60, preferably in one piece therewith, is a centering configuration 60*a* in the form of a centering stem which protrudes from cover 60, in a direction away from the locating bearing-side longitudinal end 46*a* of drive configuration 46, or from drive axial end 28*a* of working assembly 28, toward second support structure area 30*a*. Centering stem 60*a* protrudes into a counterpart centering configuration 74*b*, embodied as a centering recess, on connecting flange 74, and thereby centers milling drum tube 42, connected rigidly to connecting flange 74, with respect to drive axis A. Cover 60 comprises a central recess 60*b*, passing axially through it, through which piston rod 63 in FIG. 2 is able to pass axially.

Milling drum 32 is thus braced against counterpart support cone 51 and on connecting flange 74 coaxially to drive axis A against drive configuration 46.

At the end region of centering stem 60*a* facing toward retention axial end 28*b*, recess 60*b* in centering stem 60*a* is provided with an internal thread into which the central retaining bolt 78 is threaded.

In an alternative embodiment, centering stem 60*a* is able to pass through connecting flange 74 and protrude axially from cover 60 of drive configuration 46. Centering stem 60*a* would then be the assembly-side bearing configuration.

A bolt head 78*b* clamps bearing stem 74*a*, and with it connecting flange 74 and with that in turn connecting ring 70 and milling drum tube 42, axially against support cone 50 of drive configuration 46.

When milling drum 32 is arranged axially at a distance from its operating position but still with a certain prepositioning, for example such that the longitudinal end of centering stem 60*a*, which is located remotely from support ring 58, is already projecting into centering recess 74*b* of connecting flange 74, it is thus possible to move milling drum 32 with central retaining bolt 78 axially into its operating position. Care must simply be taken that transmission components 80 in the exemplary shape of pins provided on cover 60 at a radial distance from drive axis A are able to travel into recesses 74*c*, provided for this purpose, of connecting flange 74, so as thereby to couple cover 60 to connecting flange 74 in order to transmit torque between drive configuration 46 and milling drum 32.

As an alternative to pulling or clamping milling drum 32 onto drive configuration 46 using retaining bolt 78, milling drum 32 can also be slid through the pivotable side door 30*a* onto drive configuration 46. During this sliding-on operation, not only is counterpart centering configuration 74*b* slid onto centering stem 60*a*, but rotary bearing assembly 85 is preferably also slid onto bearing stem 74*a*.

In order to facilitate the conveying, described in the preceding paragraph, of milling drum 32 into an operational position simply by pivoting side door 30*a* into its closed position shown in FIG. 3, in which it closes off milling drum housing 30, earth working machine 10 preferably comprises an actuator that assists the pivoting of side door 30*a* at least in one movement direction, and at least in a movement range including the closed position. Particularly preferably, this is a final movement range when moving side door 30*a* into the closed position. The force needed in order to slide milling drum 32 onto drive configuration 46, and also the force needed to slide rotary bearing assembly 85 onto bearing stem 74*a*, may thus be applied entirely or at least partly by the actuator. Such an actuator may comprise, for example, one or several piston-cylinder arrangements. The cylinder is preferably pivot-mounted on machine frame 12. When side door 30*a* has been brought sufficiently close to an engagement configuration of the piston rod with the piston rod extended, side door 30*a* may be brought into engagement with the engagement configuration of the piston rod, preferably into a positive engagement transferring a particularly large amount of force, so that the one or several piston-cylinder arrangements may then at least assist, preferably independently execute, the remainder of the closing movement of side door 30*a*.

Preferably the actuator is also able to assist or in fact execute the pivoting movement of side door 30*a* together with rotary bearing assembly 85 in an initial movement range of the pivoting movement of side door 30*a* out of the closed position toward the access position, the range over which rotary bearing assembly 85 is pulled off bearing stem 74*a*. Alternatively or additionally, the actuator may also be an electromechanical actuator.

Figure 4:
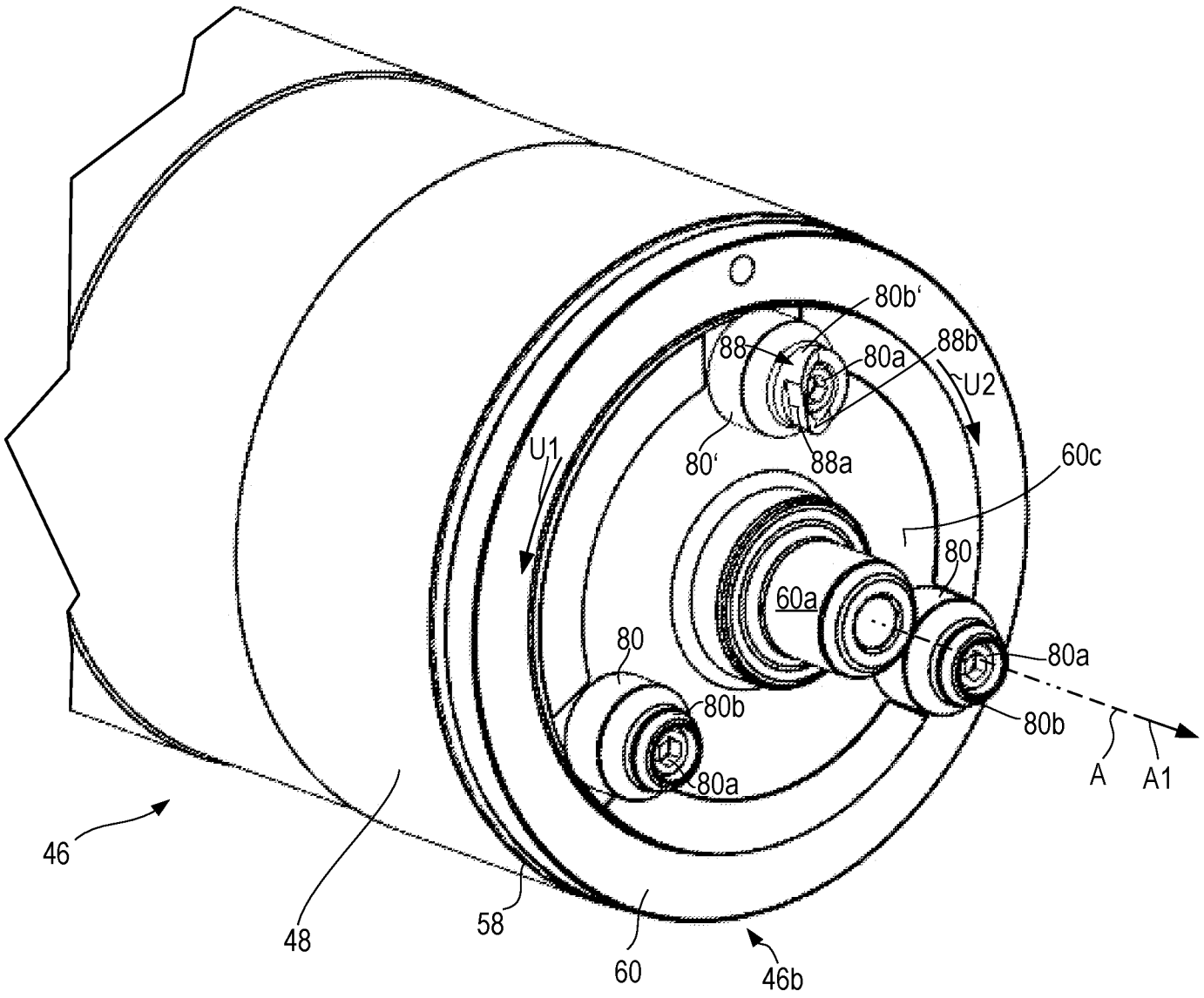
Figure 4:
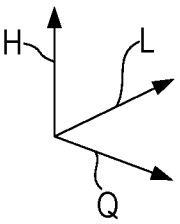

FIG. 4 shows the non-locating bearing-side longitudinal end 46*b* and an adjacent section of internal tube 48 of drive configuration 46 in a perspective view. The hydraulic coupling configuration 68 shown in FIG. 2 is not depicted in FIG. 4 on end face 60*c* for the sake of better clarity.

The viewer of FIG. 4 looks onto end face 60*c* of cover 60, from the center of which centering stem 60*a* protrudes and which is surrounded at a radial distance in exemplary fashion by three transmission components 80 equidistant from one another in the circumferential direction. The upper (in FIG. 3) transmission component is designed having a driver configuration 88 on its freely protruding longitudinal end located remotely from end face 60*c*. In the depicted example, only this upper transmission component 80' is designed having a driver configuration 88, which is why for differentiation from the remaining two transmission components 80 it is designated by an apostrophe as transmission component 80'.

Figure 5:
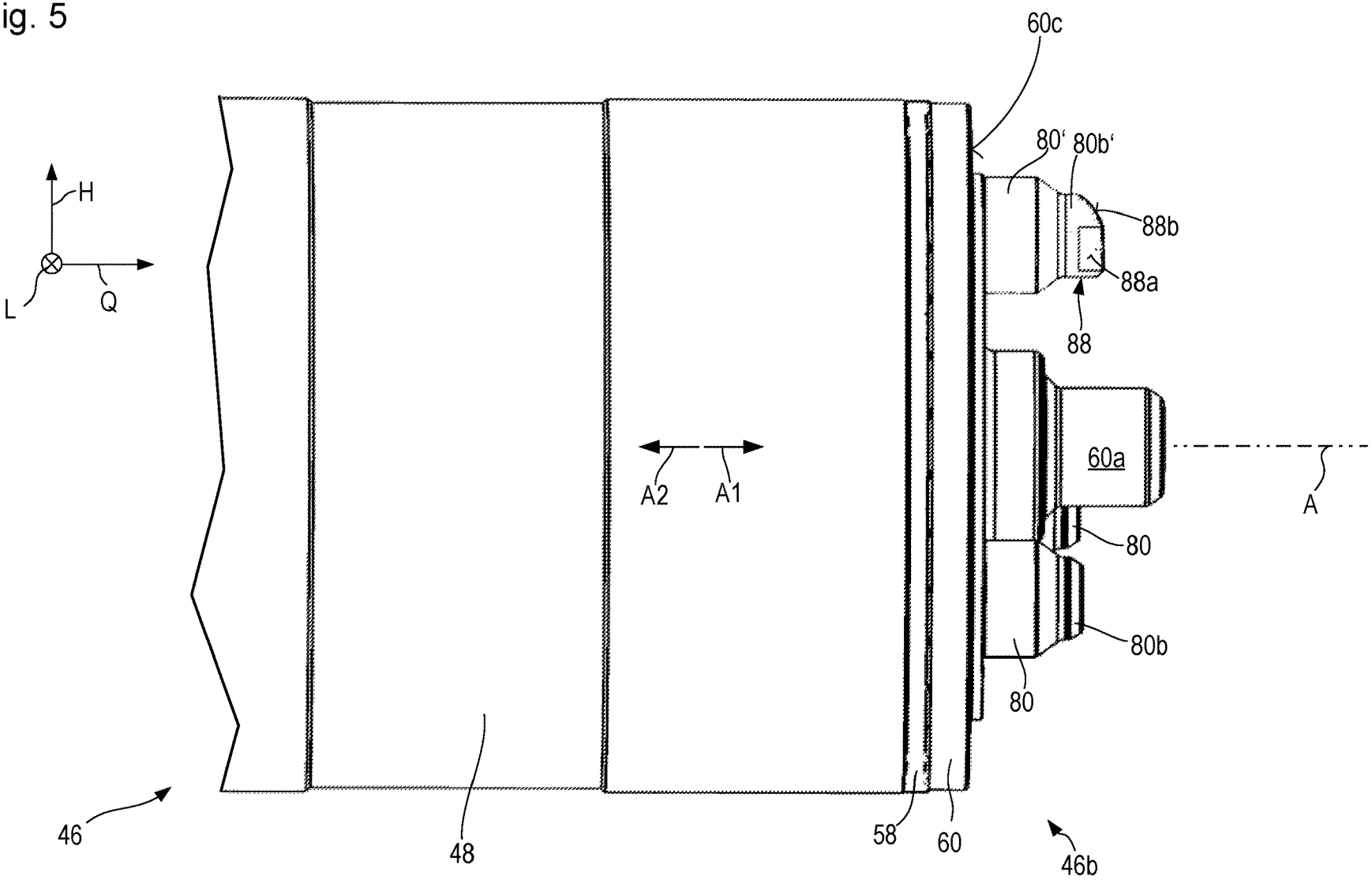

All transmission components 80 and 80' are fastened on cover 60 by a bolt 80*a* passing through them centrally. While a collar 80*b* surrounding the head of bolt 80*a* of unmodified transmission components 80 ends with an end face orthogonal to drive axis A, the transmission component 80' comprising driver configuration 88 protrudes axially further from end face 60*c*, a circumferential section of collar 80*b'* surrounding fastening bolt 80*a* being developed as driver configuration 88 (see also FIG. 5).

For earth-removing work, the rotary drive described above is able to drive drive configuration 46 to rotate in only one direction of rotation, which is the first circumferential direction indicated in FIG. 4 by U1. Driver configuration 88 has a driver surface 88*a*, in the depicted example a flat driver surface 88*a*, which faces into the first circumferential direction U1. The flat driver surface 88*a* preferably lies in a plane containing drive axis A.

Figure 7:
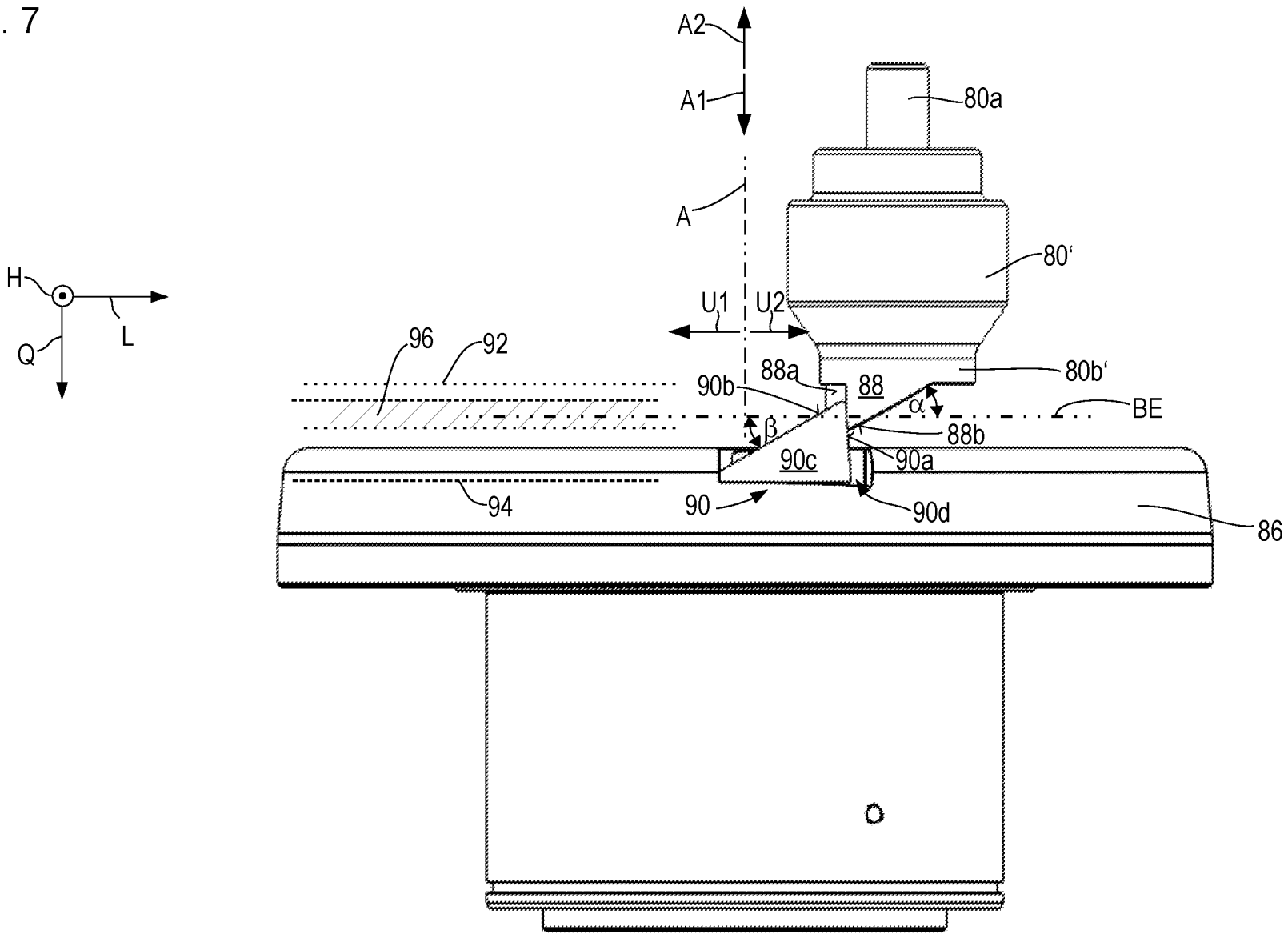

In an opposite second circumferential direction U2, starting from driver surface 88*a*, an alignment surface 88*b* extends facing mainly in the axial direction, which, as shown in FIG. 7, is inclined with respect to a reference plane BE orthogonal to drive axis A in such a way that with increasing distance from driver surface 88*a* it axially approaches in second circumferential direction U2 the drive axial end 28*a* of working assembly 28 or likewise the locating bearing-side longitudinal end 46*a* of drive configuration 46.

Figure 6:
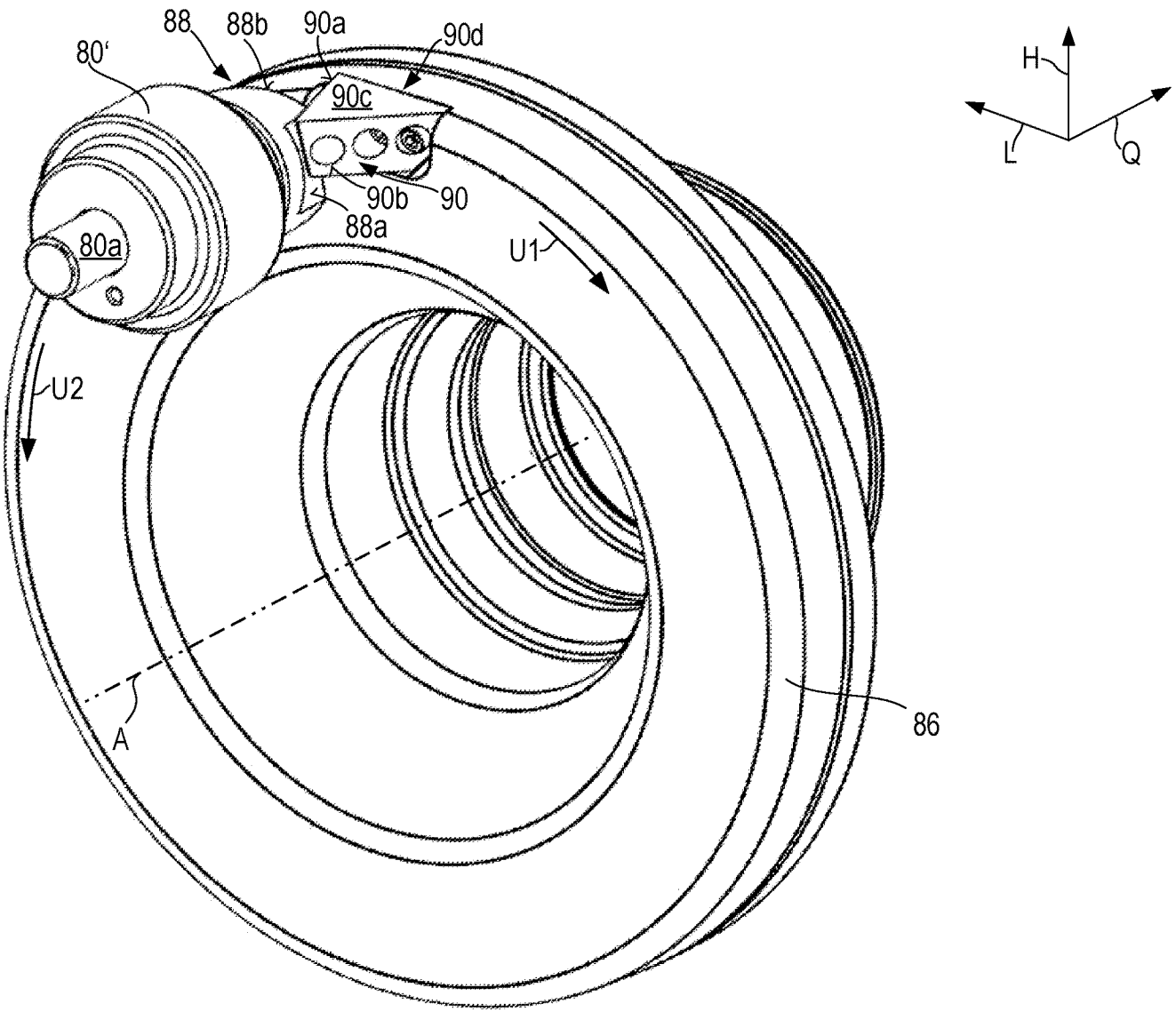

FIGS. 6 and 7 show a torque-transmitting engagement of driver configuration 88 with a driver counterpart configuration 90 on bearing sleeve 86. In order to be able to show the engagement of driver configuration 88 and driver counterpart configuration 90 as clearly as possible, FIGS. 6 and 7 show only the transmission component 80' comprising driver configuration 88, its fastening bolt 80*a*, driver counterpart configuration 90 and bearing sleeve 86 supporting the latter. In the context of the previously explained FIGS. 2 through 5 it is clear, however, how the components depicted in FIGS. 6 and 7 are arranged on milling drum housing 30 or on road milling machine 10.

Driver counterpart configuration 90 has a, preferably again flat, driver counterpart surface 90*a* facing in the second circumferential direction U2, which is in torque-transmitting abutting engagement with driver surface 88*a*. Starting from driver counterpart surface 90*a*, an alignment counterpart surface 90*b*, likewise facing mainly in the axial direction, extends in the first circumferential direction U1, which, as is likewise seen in FIG. 7, is inclined with respect to reference plane BE in such a way that with increasing distance from driver counterpart surface 90*a* it axially recedes in second circumferential direction U2 from axial drive end 28*a* of working assembly 28 as well as from locating bearing-side longitudinal end 46*a* of drive assembly 46.

As driver surface 88*a* and driver counterpart surface 90*a* both point in the circumferential direction, but both in opposite circumferential directions U1 and U2, respectively, alignment surface 88*b* and alignment counterpart surface 90*b* both point in axial directions, but in opposite axial directions A1 and A2, respectively (see FIG. 7).

The functional surfaces of driver counterpart configuration 90, the driver counterpart surface 90*a* and the alignment counterpart surface 90*b*, are formed on a projection component 90*c*, which is inserted as a separate component into a depression 90*d* in bearing sleeve 86 and is there releasably fastened, for example by three bolts. Depression 90*d* is a functional component of driver counterpart configuration 90.

The torque transmitted from driver configuration 88 to driver counterpart configuration 90 may be transmitted both via the fastening bolts of projection component 90*c* as well as via the flanks of depression 90*d* from projection component 90*c* to bearing sleeve 86 and thereby to rotary bearing assembly 85. Furthermore, depression 90*d* is able to provide a plane fastening surface for situating projection component 90*c*.

In principle, projection component 90*c* may also be welded to bearing sleeve 86. A releasable attachment, however, is preferable for exchanging worn projection components. Likewise, in the event of excessive wear, transmission component 80' may be replaced quickly, simply and safely with an unworn transmission component 80' by releasing its sole fastening bolt 80*a*.

The flat driver counterpart surface 90*a* is also preferably situated in a plane containing drive axis A.

Furthermore, as seen in FIG. 7, alignment surface 88*b* and alignment counterpart surface 90*b* are inclined in terms of absolute value by approximately the same angle $\alpha$ and $\beta$, respectively, with respect to reference plane BE so that these surfaces, when making contact with one another, abut in planar fashion against one another and are parallel or coplanar.

Angles α and β are respectively at least 25°, preferably at least 30°, in order to avoid self-locking in the event that alignment surface 88*b* and alignment counterpart surface 90*b* abut against one another and to ensure that if driver configuration 88 and driver counterpart configuration 90, in an attempt to establish the reference state described above and shown in FIGS. 2 and 3, not only overlap one another in the circumferential direction, but have force applied in the axial direction upon one another, are driven by this axial force on the abutting engagement of alignment surface 88*b* and alignment counterpart surface 90*b* to perform a relative rotation and are able to slide past one another during an axial approach movement. This prevents damage to driver configuration 88 and to driver counterpart configuration 90 in the event of a collision.

FIG. 7 shows with reference character 92 the movement space of driver surface 88*a* and with reference character 94 the movement space of driver counterpart surface 90*a*. These are the spaces 92 and 94 through which the associated surfaces 88*a* and 90*a* move during a rotation about drive axis A. The overlapping region jointly occupied by the two movement spaces 92 and 94, in which movement spaces 92 and 94 overlap, is shown in FIG. 7 sectionally in hatched fashion and is indicated by reference character 96. Due to this overlapping region 96, driver surface 88*a* comes into abutting engagement with driver counterpart surface 90*a* even when the two surfaces immediately following the establishment of the reference state are situated in the circumferential direction about drive axis A at a distance from one another and a relative rotation occurs between bearing stem 74*a* and the bearing sleeve 86 about drive axis A during a working operation. On account of alignment surface 88*b* and alignment counterpart surface 90*b*, however, such a relative rotation between bearing stem 74*a* and bearing sleeve 86 cannot even amount to one revolution.

Figure 8:
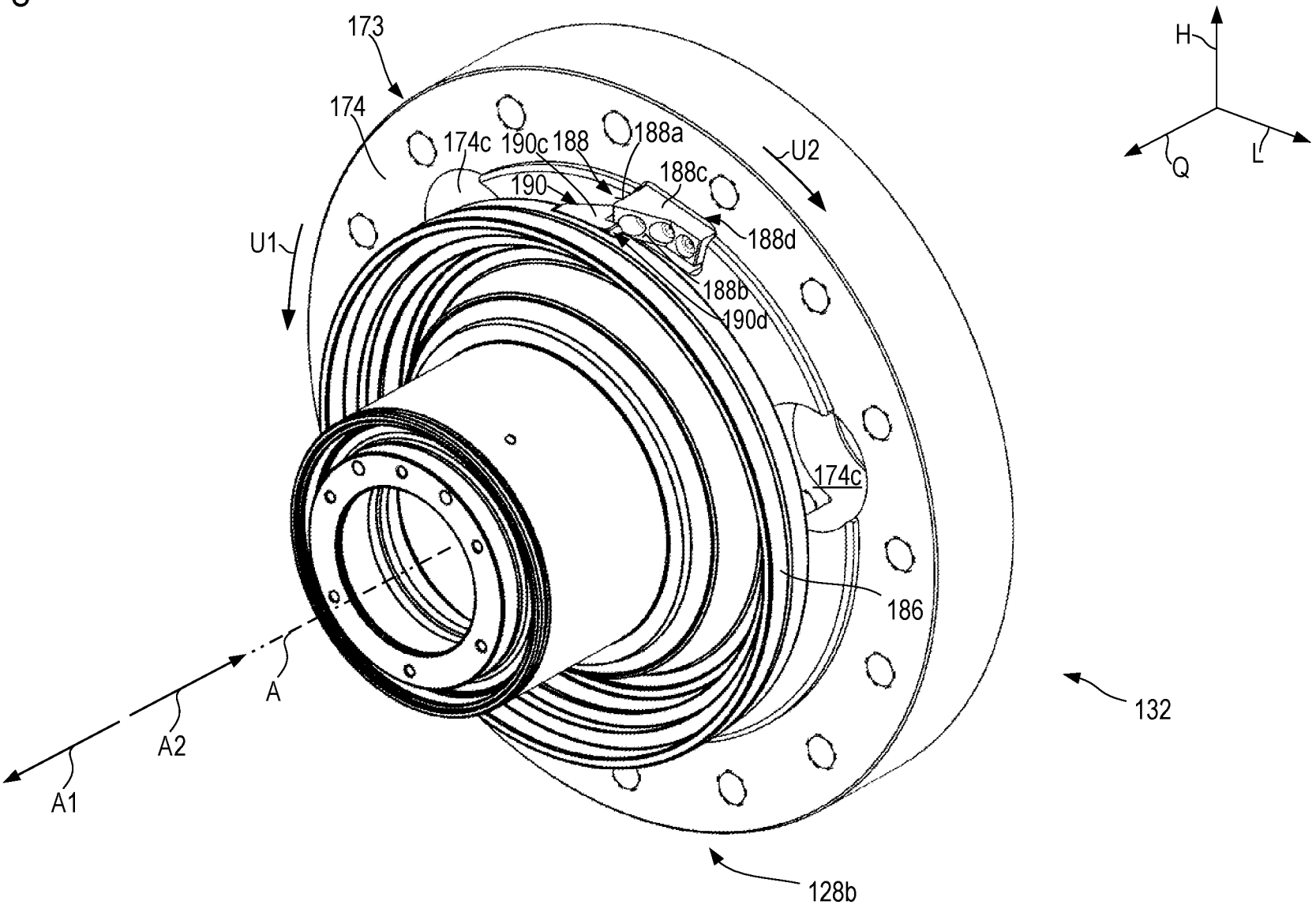

Deviating from the merely exemplary depiction in FIGS. 4 through 7, driver configuration 88 may be situated on the milling drum, preferably on connecting structure 73. For example, the driver configuration may be situated on the connecting flange, for example in a depression, preferably in releasable fashion. Such a second specific embodiment is shown in FIG. 8. Components and component portions identical and functionally identical to those in the first specific embodiment are labeled in the second specific embodiment with the same reference characters but incremented by 100. The second specific embodiment is explained below only insofar as it differs from the first specific embodiment.

In the second specific embodiment shown in FIG. 8, driver configuration 188 is situated on connecting structure 173. In connecting structure 173, bearing stem is designed as an extra component separate from connecting flange 174. The extra bearing stem component and the bearing stem itself are concealed by bearing sleeve 186 in FIG. 8.

Driver configuration 188 comprises a projection component 188*c*, on which driver surface 188*a* and alignment surface 188*b* are developed and oriented in the manner described above, and which is inserted into a depression 188*d* of driver configuration 188 and is there fixated by bolts in a manner designed to be releasable. Depression 188*d* is formed in an end face of connecting flange 174.

Driver counterpart configuration 190 corresponds to driver counterpart configuration 90 of the first specific embodiment. Optionally, projection components 90*c* and 188*c* may be identical so that it is only necessary to produce a single type of projection component for forming an engagement assembly comprising a driver configuration and a driver counterpart configuration.

The remainder of the earth working machine of the second specific embodiment is unchanged compared to the one shown in FIG. 1.

The invention claimed is:

1. An earth working machine, comprising:

a support structure including a first support structure area and a second support structure area;

a working assembly mounted on the support structure so as to be rotatable about a drive axis relative to the support structure, the drive axis defining an axial direction running longitudinally with respect to the drive axis, a radial direction running orthogonally with respect to the drive axis, and a circumferential direction running about the drive axis, in a reference state of the working assembly ready for a rotation of the working assembly about the drive axis;

a first rotary bearing rotatably mounting the working assembly in the first support structure area at a drive axial end of the working assembly;

a rotary bearing arrangement rotatably mounting the working assembly in the second support structure area at a retention axial end of the working assembly, the retention axial end being situated oppositely from the drive axial end in the axial direction, the rotary bearing arrangement including a second rotary bearing, an assembly side bearing configuration connected to the working assembly and a structure-side bearing configuration connected to the support structure such that the structure-side bearing configuration remains connected to the support structure when the support structure is separated from the working assembly;

wherein the assembly-side bearing configuration includes one of a bearing stem or a bearing sleeve connected to the retention axial end of the working assembly;

wherein the structure-side bearing configuration includes the other of the bearing stem or the bearing sleeve connected to the second support structure area;

wherein the bearing sleeve surrounds the bearing stem in the reference state, both the bearing sleeve and the bearing stem being rotatable about the drive axis relative to the second support structure area in the reference state, and the bearing stem and the bearing sleeve are configured to be axially removable from one another and thereby separable from one another;

wherein the working assembly includes a driver configuration including a driver surface facing in a first circumferential direction, the driver surface moving through a first movement space during a rotation of the driver surface about the drive axis;

wherein the structure-side bearing configuration includes a driver counterpart configuration including a driver counterpart surface facing in a second circumferential direction opposite to the first circumferential direction, the driver counterpart surface moving through a second movement space during a rotation of the driver counterpart surface about the drive axis; and wherein the first and second movement spaces overlap in the axial direction in the reference state.

2. The earth working machine of claim 1, wherein:

the driver surface and the driver counterpart surface are in an abutting engagement configured to transmit force in the first circumferential direction.

3. The earth working machine of claim 1, wherein:

the driver counterpart configuration includes a depression and/or a projection.

4. The earth working machine of claim 1, wherein:

the driver counterpart configuration includes a projection releasably fixed in a depression in the structure-side bearing configuration.

5. The earth working machine of claim 1, wherein:

the working assembly includes a drive configuration supported at the drive axial end of the working assembly in the first support structure area by the first rotary bearing, the drive configuration being rotatable about the drive axis and protruding axially away from the first support structure area, the drive configuration supporting the driver configuration.

6. The earth working machine of claim 5, wherein:

the drive configuration at a longitudinal end of the drive configuration remote from the first rotary bearing includes an end face facing in the axial direction, the end face supporting the driver configuration.

7. The earth working machine of claim 5, wherein:

the drive configuration is configured to releasably mount a milling drum, the drive configuration including a plurality of projecting transmission components configured to transmit torque to the milling drum, at least one of the transmission components including the driver configuration.

8. The earth working machine of claim 5, wherein:

the working assembly includes a milling drum coaxial with the drive configuration in the reference state, the milling drum including a milling drum tube and a plurality of milling bit holders located on an outside of the milling drum tube, the milling bit holders being configured to receive milling bits, the milling drum including at the retention axial end of the working assembly a connecting structure running transverse to the drive axis; and the driver configuration is supported by the drive configuration and extends axially past the connecting structure or through the connecting structure thereby protruding beyond the connecting structure to the structure-side bearing configuration.

9. The earth working machine of claim 1, wherein:

the working assembly includes a milling drum, the milling drum including a milling drum tube and a plurality of milling bit holders located on an outside of the milling drum tube, the milling bit holders being configured to receive milling bits, the milling drum supporting the driver configuration.

10. The earth working machine of claim 9, wherein:

the milling drum at the retention axial end of the working assembly includes a connecting structure running transverse to the drive axis, the connecting structure connecting the milling drum tube with the assembly-side bearing configuration, the connecting structure supporting the driver configuration.

11. The earth working machine of claim 1, wherein:

the second support structure area is configured such that starting from the reference state the second support structure area together with the structure-side bearing configuration can be swiveled away from the first support structure area about a swivel axis transverse to the drive axis.

12. The earth working machine of claim 11, wherein:

the swivel axis is orthogonal to the drive axis.

13. The earth working machine of claim 1, wherein:

the support structure is connected to a machine frame of the earth working machine in the reference state.

14. An earth working machine, comprising:

a support structure including a first support structure area and a second support structure area;

a working assembly mounted on the support structure so as to be rotatable about a drive axis relative to the support structure, the drive axis defining an axial direction running longitudinally with respect to the drive axis, a radial direction running orthogonally with respect to the drive axis, and a circumferential direction running about the drive axis, in a reference state of the working assembly ready for a rotation of the working assembly about the drive axis;

a first rotary bearing rotatable mounting the working assembly in the first support structure area at a drive axial end of the working assembly;

a rotary bearing arrangement rotatably mounting the working assembly in the second support structure area at a retention axial end of the working assembly, the retention axial end being situated oppositely from the drive axial end in the axial direction, the rotary bearing arrangement including a second rotary bearing, an assembly side bearing configuration connected to the working assembly and a structure-side bearing configuration connected to the support structure;

wherein the assembly-side bearing configuration includes one of a bearing stem or a bearing sleeve connected to the retention axial end of the working assembly;

wherein the structure-side bearing configuration includes the other of the bearing stem or the bearing sleeve connected to the second support structure area;

wherein the bearing sleeve surrounds the bearing stem in the reference state, both the bearing sleeve and the bearing stem being rotatable about the drive axis relative to the second support structure area in the reference state, and the bearing stem and the bearing sleeve are configured to be axially removable from one another and thereby separable from one another;

wherein the working assembly includes a driver configuration including a driver surface facing in a first circumferential direction, the driver surface moving through a first movement space during a rotation of the driver surface about the drive axis;

wherein the structure-side bearing configuration includes a driver counterpart configuration including a driver counterpart surface facing in a second circumferential direction opposite to the first circumferential direction, the driver counterpart surface moving through a second movement space during a rotation of the driver counterpart surface about the drive axis;

wherein the first and second movement spaces overlap in the axial direction in the reference state;

wherein the driver configuration includes an alignment surface facing axially away from the drive axial end in the reference state;

wherein the driver counterpart configuration includes an alignment counterpart surface facing axially toward the drive axial end in the reference state;

the alignment surface being inclined with respect to a reference surface that is orthogonal to the drive axis such that the alignment surface approaches the drive axial end with increasing circumferential distance from the driver surface along the second circumferential direction; and the alignment counterpart surface being inclined with respect to the reference surface such that the alignment counterpart surface recedes from the drive axial end with increasing circumferential distance from the driver counterpart surface along the first circumferential direction.

15. The earth working machine of claim 14, wherein:

the alignment surface is inclined with respect to the reference surface at an angle ($\alpha$) of at least 25° and the alignment counterpart surface is inclined with respect to the reference surface at an angle ($\beta$) of at least 25°.

16. The earth working machine of claim 15, wherein:

the angles of inclination ($\alpha$, $\beta$) of the alignment surface and of the alignment counterpart surface are equal in terms of absolute value.

* * * * *